US012559298B2

(12) United States Patent
Venrath

(10) Patent No.: US 12,559,298 B2
(45) Date of Patent: Feb. 24, 2026

(54) CONTAINER

(71) Applicant: Jule Lucia Venrath, Stuttgart (DE)

(72) Inventor: Jule Lucia Venrath, Stuttgart (DE)

( * ) Notice: Subject to any disclaimer, the term of this patent is extended or adjusted under 35 U.S.C. 154(b) by 137 days.

(21) Appl. No.: 18/288,764

(22) PCT Filed: Apr. 16, 2022

(86) PCT No.: PCT/EP2022/060198
§ 371 (c)(1),
(2) Date: Oct. 27, 2023

(87) PCT Pub. No.: WO2022/228926
PCT Pub. Date: Nov. 3, 2022

(65) Prior Publication Data

US 2024/0208716 A1 Jun. 27, 2024

(30) Foreign Application Priority Data

Apr. 30, 2021 (EP) ..... 21171712

(51) Int. Cl.
*B65D 83/00* (2006.01)
*B65D 81/38* (2006.01)

(52) U.S. Cl.
CPC ..... *B65D 83/771* (2025.01); *B65D 81/3841* (2013.01); *B65D 2583/005* (2013.01)

(58) Field of Classification Search
CPC ..... B65D 83/771; B65D 81/3841; B65D 2583/005
See application file for complete search history.

(56) References Cited

U.S. PATENT DOCUMENTS 677,851 A 7/1901 Booth
4,098,434 A * 7/1978 Uhlig ..... B65D 83/771 222/105

(Continued)

FOREIGN PATENT DOCUMENTS

BR 112023022491 A2 1/2024
CA 3217122 A1 11/2022

(Continued)

OTHER PUBLICATIONS

Soroka, Walter. Illustrated Glossary of Packaging Terminology. Lancaster, PA, USA: DEStech Publications, Inc., 2008. ISBN 1930268270. p. 51.

(Continued)

*Primary Examiner* — Timothy L Maust
(74) *Attorney, Agent, or Firm* — Harness, Dickey & Pierce, P.L.C.

(57) ABSTRACT

Problem A container for viscous substances, especially liquids, is typically operated such that discharge is effected by, for example, folding or pumping action exerted by a means provided atop the container. Complete emptying of a conventional container in most cases cannot be achieved. Some residues may be removed by the action of gravity. However, for substances of higher viscosity, retrieving residues from the container remains a challenge. Furthermore, the shelf life of the fluid may be adversely affected by ambient air entering the container as it is being emptied. The invention aims to facilitate an almost complete discharge of a container, regardless of gravity. Moreover, the viscous fluid is to be preserved in vacuum to prolong its shelf life. Solution Container for a preferably viscous fluid having a compressible, preferably elastic, outer body (1) and an inner body (2) opening out of the container and comprising the fluid, characterized in that captive air is enclosed between the outer body (1) and inner body (2) and the inner body (2)

(Continued)

is affixed within the outer body (1) such that when compressive force is applied upon the outer body (1), the captive air transfers the force unto the inner body (2), displacing and discharging the fluid from the container.

14 Claims, 7 Drawing Sheets

(56) References Cited

U.S. PATENT DOCUMENTS

| | | | | |
|---|---|---|---|---|
| 5,303,852 | A * | 4/1994 | Yamawaki | B65D 83/771 222/386.5 |
| 7,267,248 | B2 * | 9/2007 | Yerby | B65D 83/62 222/402.18 |
| 7,641,078 | B2 | 1/2010 | Boumnso | |
| 2006/0065132 | A1 | 3/2006 | Jongen et al. | |
| 2010/0230438 | A1 | 9/2010 | Sardo, Jr. | |
| 2024/0208716 | A1 | 6/2024 | Venrath | |

FOREIGN PATENT DOCUMENTS

| | | | | |
|---|---|---|---|---|
| CN | 117597293 | A | 2/2024 | |
| EP | 4082936 | A1 | 11/2022 | |
| EP | 4082936 | | 10/2023 | |
| EP | 4082936 | B1 | 10/2023 | |
| EP | 4330158 | A1 | 3/2024 | |
| GB | 2536886 | A * | 10/2016 | B65D 47/2018 |
| JP | 2024516428 | A | 4/2024 | |
| KR | 20240004579 | A | 1/2024 | |
| MX | 2023012831 | A | 1/2024 | |
| WO | 2022228926 | A1 | 11/2022 | |

OTHER PUBLICATIONS

International Search Report of the ISA issued in PCT/EP2022/060198, mailed Jul. 15, 2022; ISA/EP.

* cited by examiner

CONTAINER

CROSS-REFERENCE TO RELATED APPLICATION

This application is a 371 U.S. National Phase of International Application No. PCT/EP2022/060198, filed Apr. 16, 2022, which claims priority to European Application No. 21171712.9, filed Apr. 30, 2021. The entire disclosures of the above applications are incorporated herein by reference.

TECHNICAL FIELD

The invention relates to the product as per the first portion of [Claim 1].

BACKGROUND ART

In packaging, by container is meant any receptacle or enclosure for holding a product used in storage, packaging, and transportation, including shipping (cf. NPL 1).

PTL 1 discloses a container for a viscous fluid having a compressible outer body and an inner body opening out of the container and comprising the fluid.

SUMMARY OF INVENTION

The invention is set out in the appended set of claims.

Technical Problem

In a container for viscous substances, especially liquids, discharge may be effected by, for example, folding or pumping action exerted by a means provided atop the container. Complete emptying of a conventional container in most cases cannot be achieved. Some residues may be removed by the action of gravity. However, for substances of higher viscosity, retrieving residues from the container remains a challenge. Furthermore, the shelf life of the fluid may be adversely affected by ambient air entering the container as it is being emptied.

The invention aims to facilitate an almost complete discharge of a container, regardless of gravity. Moreover, the viscous fluid is to be preserved in vacuum to prolong its shelf life.

Solution to Problem

The problem is solved as per the second portion of [Claim 1]. Specifically, the fluid is dispensed by manual pressure on the airtight container. Air retained in the space between the two packaging bodies transfers the force to the fluid inside the inner body. The overpressure induced by this pumping action unloads the fluid from an orifice of the inner body.

Advantageous Effects of Invention

By means of an embodiment according to the invention, a container can be depleted entirely. Since the air pressure inside the packaging forces the fluid towards its egress port, the contents may even be extracted against the force of gravity acting on the device. Therefore, the container could be firmly anchored in place, its aperture facing up, and still be completely emptied.

The invention further satisfies the requirements of sustainability by minimizing consumption of resources as compared to a conventional container. To this end, the outer body of the container is reusable and may thus be optimized for quality. Its inner body can be manufactured from only a thin fabric in the shape of a bag, pouch, or pocket, equipped with a delicate fastener at its outlet and devoid of any valve.

Owing to the captive air enclosed between its outer and inner bodies, the proposed container exhibits improved thermal insulation, akin to the operating principle of a vacuum flask.

For easy and safe handling, an advanced embodiment may be equipped with a replaceable pouch arranged beyond the cavity containing the captive air. With no scaling of the pouch being required vis-à-vis any other part of the container, replenishment of the latter may be considered virtually foolproof. Moreover, clogging of fluid near the outlet is effectively prevented.

DESCRIPTION OF EMBODIMENTS

Figure 1:
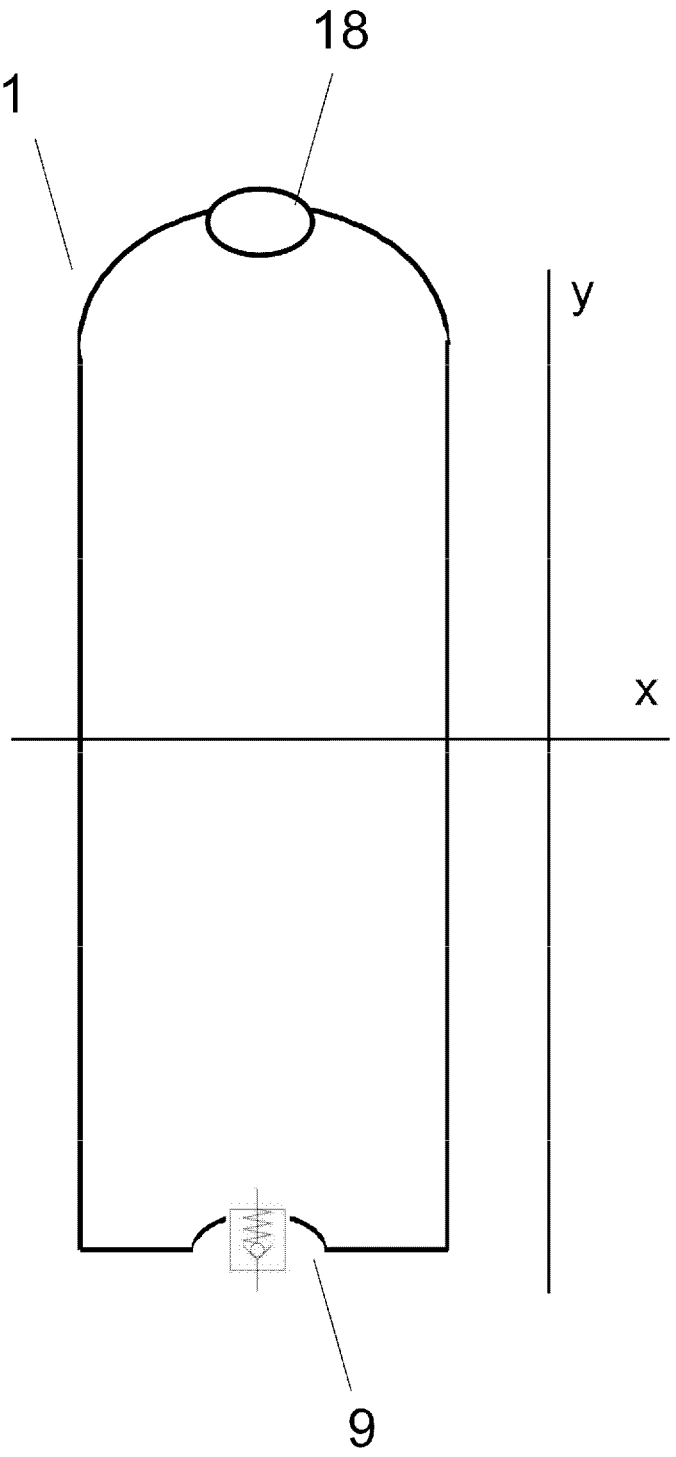
FIG. 1 is a longitudinal section of an outer body.

[FIG. 1] shows an elastic outer body (1) having a collar (18) formed at its upper end. The outer body (1) may be opened along an axis (x, y) by means of a rear hinge or similar device. Alternatively, the outer body (1) could be split along either axis (x, y) and re-joined into its original shape by screwing, clicking, or the like.

Figure 2:
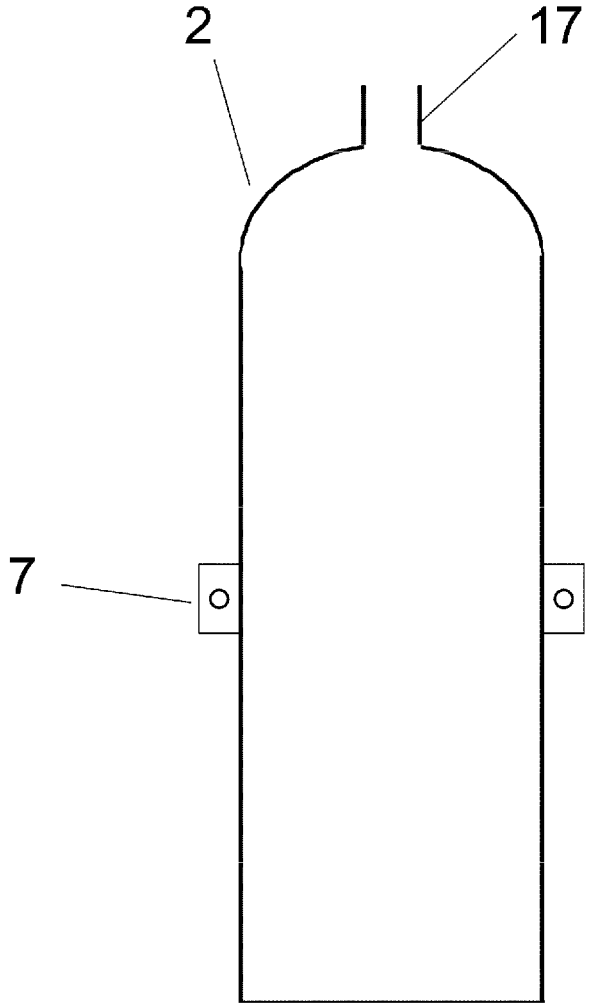
FIG. 2 is a longitudinal section of an inner body

FIG. 2 shows an inner body (2) having a threaded outlet (17) formed at its upper end that joins tightly into the collar (18) of [FIG. 1]. Wholly or in part, the inner body (2) may be equipped with fixing members or tab-like protrusions to fixate it within the outer body (1).

Figure 3:
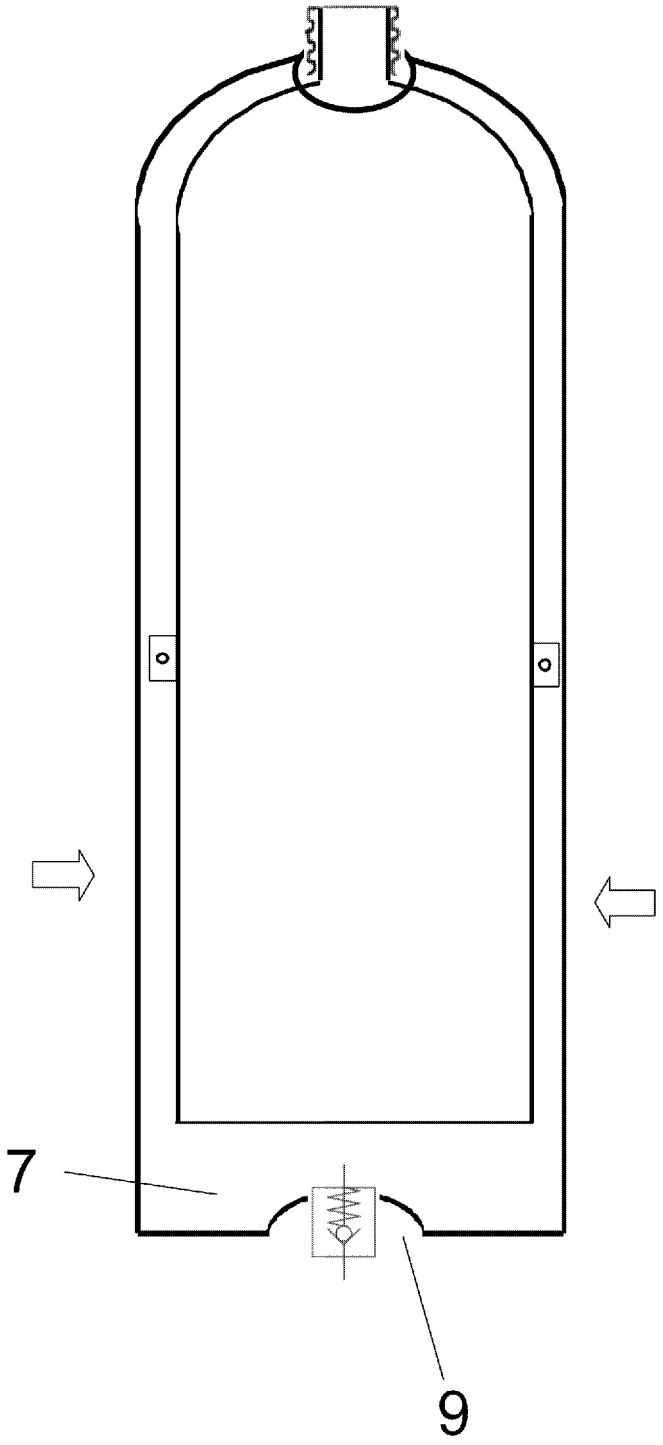
FIG. 3 is a longitudinal section of a first container.

FIG. 3 shows the outer body (1) and inner body (2) in their envisaged interlocked configuration, the inner body (2) opening out of the container through the collar (18) and outlet (17). As may be gathered from this drawing, a cavity (7) is formed peripherally about the inner body (2) and contains captive air enclosed between the outer body (1) and inner body (2). When compressive force is applied upon the outer body (1), the latter displaces the captive air.

In the embodiment at hand, the inner body (2) is deformable. Since the encasing outer body (1) prevents the displaced air from escaping into the atmosphere, the air thus compresses the inner body (2) which, when filled with fluid, in turn discharges a corresponding volume of said fluid through its outlet (17). As its fluid is gradually expelled, the inner body (2) contracts into itself.

A check valve (9) is fitted in the outer body (1) opposite its collar (18—[FIG. 1]). Hence, when the force subsides and the outer body (1) is decompressed, the inner body (2) may remain contracted while the added volume of the cavity (7) is filled with ambient air aspirated through the check valve (9) until the outer body (1) is fully restored.

As the compression is repeated, the pliable inner body (2) of the present embodiment will progressively decrease in volume and release its contents as required, with the check valve (9) provided on the outer body (1) supplying air to the ever-increasing volume of the cavity. Upon depletion, the inner body (2) may be conveniently removed from the container and replaced whilst the outer body (1) can be reused indefinitely.

Figure 4:
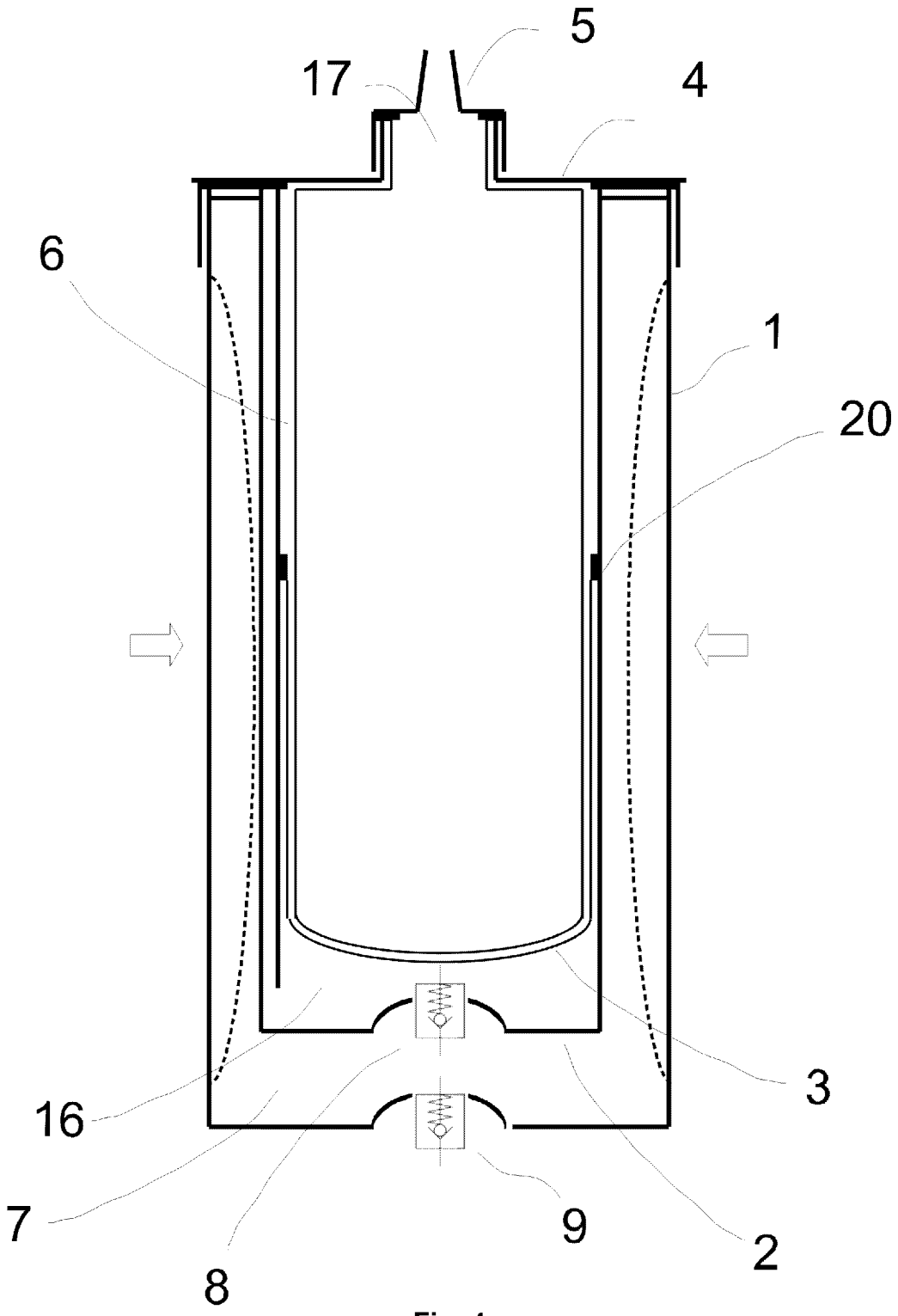
FIG. 4 is a longitudinal section of a second container.
Figure 5:
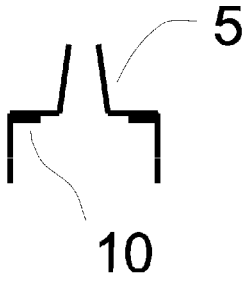
FIG. 5 is a longitudinal section of a nozzle.
Figure 6:
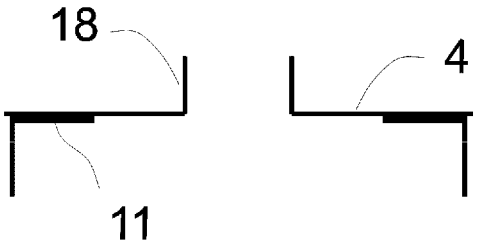
FIG. 6 is a longitudinal section of a lid.
Figure 7:
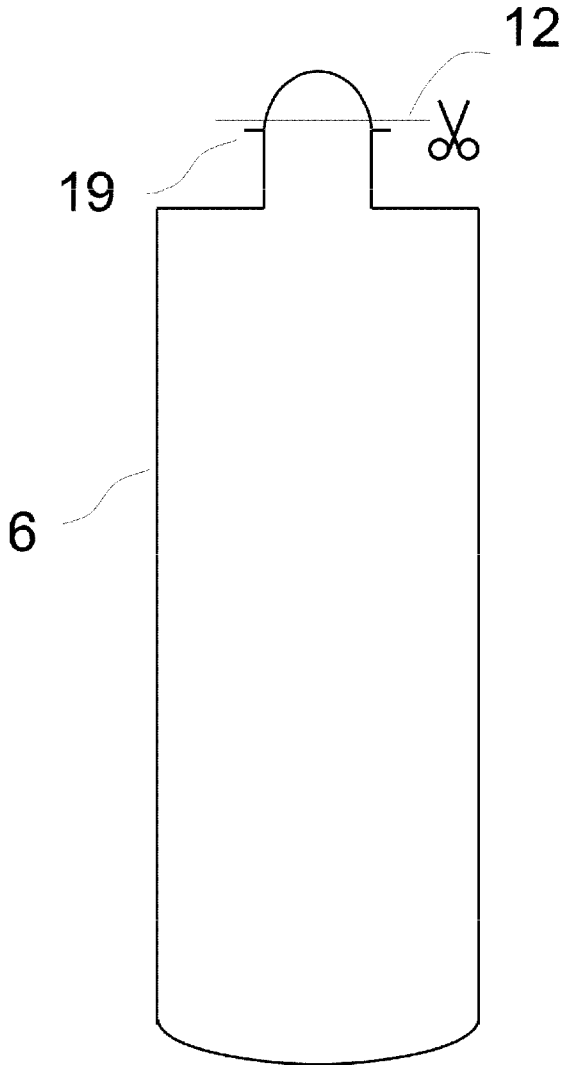
FIG. 7 is a longitudinal section of a pouch.
Figure 8:
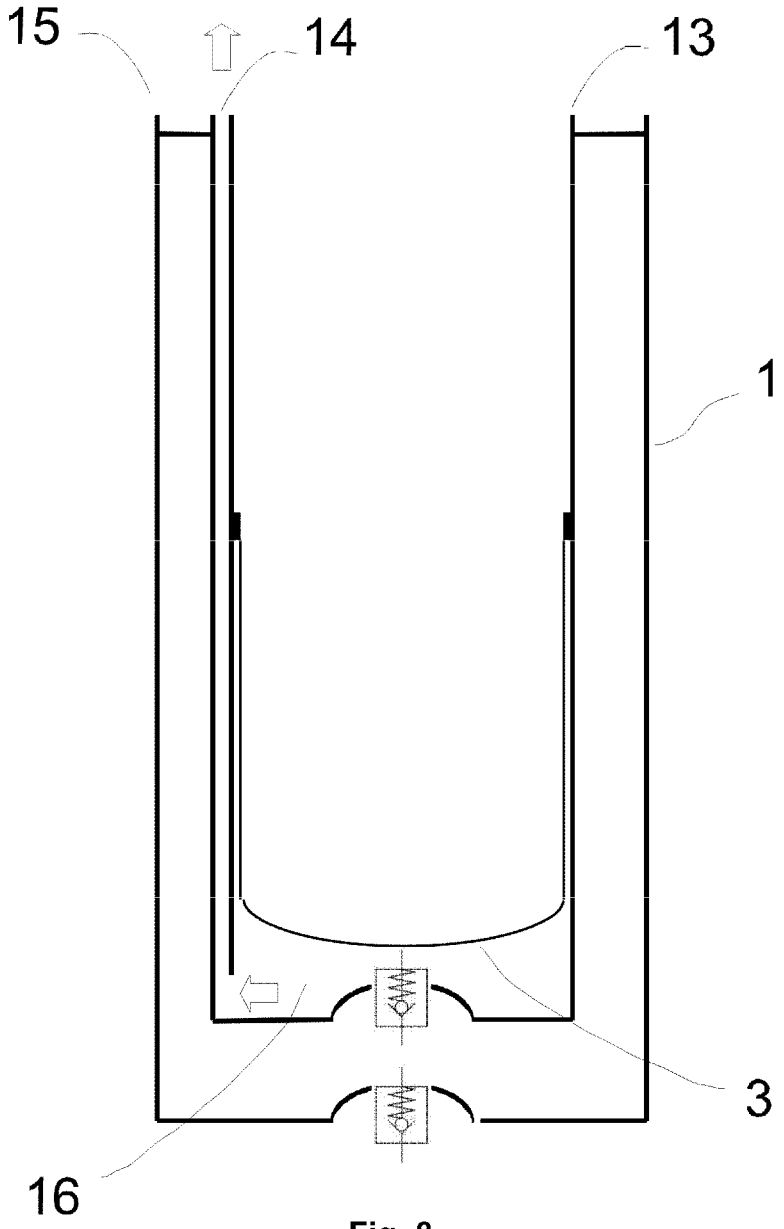
FIG. 8 is a longitudinal section of the second container in an opened state.

FIG. 4 et seqq. show an advanced embodiment having a rigid inner body (2) that opens out of the container through a removable lid (4) and is lined with an integral pouch (3). Form-fit within the inner body (2) between said integral pouch (3) and lid (4) is a further, replaceable pouch (6)—such as of textile or plastic—that contains the actual fluid.

In this variant, the force transferred onto the inner body (2) acts indirectly on the replaceable pouch (6) through the integral pouch (3). To this end, a check valve (8) is fitted in the inner body (2) opposite the lid (4). When compressed, the outer body (1)—due to the rigidity of the inner body (2)— diminishes the cavity (7) and expels the captive air into the inner body (2) through the valve (8). The latter opens out into a second cavity (16)— formed in the inner body (2) opposite the lid (4)—, into which the captive air is thus impelled. As this fluid communication progresses and the entering captive air accumulates in the second cavity (16), it gradually everts the integral pouch (3) toward the lid (4). In the process, the integral pouch (3) displaces and compresses the replaceable pouch (6), extruding, via a mouth (12) formed in the same, the fluid through a nozzle (5) mounted upon the lid (4).

As soon as the force subsides and the outer body (1) decompresses, pressure in the diminished cavity drops. To equalize the resulting underpressure and allow for the outer body (1) to return to its original shape and volume, a second check valve (9) is fitted in the outer body (1) opposite the lid (4). Through this second check valve (9), the expelled captive air is replaced by ambient air until the first cavity (7) is fully restored. This way, the squeezing action may be repeated at will until the fluid depletes, at which point the replaceable pouch (6) eventually nestles up against the lid (4) and into the nozzle (5).

To seal the first cavity (7), a gasket (11) is integrated with the lid (4) and form-fits corresponding sealing edges (13, 15) formed around the inner body (2) and outer body (1). Similarly, to prevent captive air from bypassing the pouches (3, 6) and escaping the second cavity (16) through the nozzle (5), an airproof retainer (20) around the integral pouch (3) attaches circumferentially to the inner body (2) halfway between the lid (4) and first check valve (8).

For replenishment of the container, its lid (4) may be removed, and the emptied replaceable pouch (6) disposed. As soon as the container opens, the captive air can escape from the second cavity (16) through a vent (14) extending along the inner body (2) to its sealing edge (13), allowing for the integral pouch (3) to revert to its former shape. With configuration of the inner body (2) thus restored, a compatible replacement pouch may be inserted atop the integral pouch (3) and hooked in the collar (18) by means of an integrated member (19) before attaching the lid (4). Another fastening member (10) is integrated with the nozzle (5) and form-fits the lid (4), outlet (17), and collar (18), securing the nozzle (5) as the container is re-readied for operation.

The arrangement according to the invention allows the inner body (2) to be completely emptied. For this purpose—instead of or in addition to the retainer (20)—the integral pouch (3) and body (2) may exhibit complementary fastening elements, rails, tracks, or similar. Such elements may be disposed in a horizontal or vertical straight line or plane and are adapted in number, design, and arrangement to the body (2) with respect to form and function.

INDUSTRIAL APPLICABILITY

The invention is applicable, among others, throughout the packaging industry.

| Reference Signs List | |
|---|---|
| 1 | Outer body |
| 2 | Inner body |
| 3 | Integral pouch |
| 4 | Lid |
| 5 | Nozzle |
| 6 | Replaceable pouch |
| 7 | First cavity |
| 8 | First check valve |
| 9 | Second check valve |
| 10 | First fastening member |
| 11 | Sealing gasket |
| 12 | Mouth |
| 13 | First sealing edge |
| 14 | Vent |
| 15 | Second sealing edge |
| 16 | Second cavity |
| 17 | Outlet |
| 18 | Collar |
| 19 | Second fastening member |
| 20 | Retainer |

CITATION LIST

The following documents are cited hereinbefore.

PATENT LITERATURE

PTL 1: US 677851 A (BOOTH THOMAS C US]) 09.07.1901

Non-Patent Literature

NPL 1: SOROKA, Walter. Illustrated Glossary of Packaging Terminology. Lancaster, PA, USA: DEStech Publications, Inc., 2008. ISBN 1930268270. p. 51.

The invention claimed is:

1. Container for a preferably viscous fluid having
a compressible, outer body;
an inner body opening out of the container;
a textile integral pouch lining the inner body;
a removable lid form-fit to both the outer body and inner body;
a nozzle mounted upon the lid;
a textile or plastic replaceable pouch form-fit within the inner body between the integral pouch and lid, said replaceable pouch containing the fluid; and
a mouth formed in the replaceable pouch and protruding from the lid into the nozzle such that, as the fluid is extruded via the mouth, the integral pouch progressively displaces and compresses the replaceable pouch until the replaceable pouch nestles up against the lid and into the nozzle;
wherein
captive air is enclosed between the outer body and inner body and
the inner body is affixed within the outer body such that when compressive force is applied upon the outer body, the captive air transfers the force onto the inner body, displacing and discharging the fluid from the container.

2. Container as per claim 1
wherein
under said compressive force, the captive air enters the inner body and gradually everts the integral pouch, which extrudes the fluid.

3. Container as per claim 2
wherein
the inner body opens out through the lid and
under said compressive force, the integral pouch is everted toward the lid.

4. Container as per claim 3
wherein
the inner body opens out into the nozzle such that, as the integral pouch everts, the fluid is extruded through the nozzle.

5. Container as per claim 1
wherein
a first cavity is formed peripherally about the inner body and containing the captive air, wherein
the inner body is rigid and in fluid communication with the first cavity such that under force, the outer body diminishes the first cavity and expels the captive air into the inner body.

6. Container as per claim 5
wherein
a spring-loaded first check valve is fitted opposite the lid in the inner body such that the communication is unidirectional from the first cavity to the inner body.

7. Container as per claim 6
wherein
a spring-loaded second check valve is fitted opposite the lid in the outer body such that when the force subsides and the outer body decompresses, the expelled captive air is replaced by ambient air through the second check valve and the first cavity is restored.

8. Container as per claim 7
wherein
a first fastening member is integrated with the nozzle and form-fit to the lid.

9. Container as per claim 8
wherein
a sealing gasket is integrated with the lid,
a first sealing edge is formed around the inner body, and
a second sealing edge is formed around the outer body, wherein
the gasket form-fits the sealing edges.

10. Container as per claim 9
wherein
a second cavity is formed in the inner body opposite the lid, wherein
the first check valve opens out into the second cavity such that under said force, the captive air is impelled into the second cavity.

11. Container as per claim 9 wherein
a vent extends from the first sealing edge along the inner body to the second cavity such that when the lid is removed and the integral pouch is reverted by replacing the replaceable pouch when the fluid is depleted, the captive air escapes from the second cavity through the vent.

12. Container as per claim 8
wherein
an outlet is formed in the inner body or replaceable pouch and
a collar is formed in the lid, wherein
the first fastening member form-fits the outlet and collar.

13. Container as per claim 12
wherein
a second fastening member is integrated with the replaceable pouch around the mouth and is form-fit to the collar.

14. Container as per claim 6 wherein an airproof retainer is formed approximately halfway between the lid and first check valve around the integral pouch and attaches circumferentially to the inner body.

* * * * *